US008142235B2

(12) United States Patent
Lietz et al.

(10) Patent No.: US 8,142,235 B2
(45) Date of Patent: Mar. 27, 2012

(54) ARRANGEMENT FOR CURRENT DISTRIBUTION AND CONTACT ARRANGEMENT AND FUSE PROTECTION THEREOF OF THE OUTGOING CABLES

(75) Inventors: Franz-Josef Lietz, Oberhausen-Lirich (DE); Reiner Mäckel, Königswinter (DE); Thomas Schulz, Unterensingen (DE)

(73) Assignee: Auto Kabel Managementgesellschaft mbH, Hausen i.W. (DE)

( * ) Notice: Subject to any disclaimer, the term of this patent is extended or adjusted under 35 U.S.C. 154(b) by 838 days.

(21) Appl. No.: 12/281,272

(22) PCT Filed: Mar. 1, 2007

(86) PCT No.: PCT/EP2007/001741

§ 371 (c)(1), (2), (4) Date: Oct. 10, 2008

(87) PCT Pub. No.: WO2007/101596

PCT Pub. Date: Sep. 13, 2007

(65) Prior Publication Data

US 2009/0050366 A1 Feb. 26, 2009

(30) Foreign Application Priority Data

Mar. 3, 2006 (DE) ..... 10 2006 009 936

(51) Int. Cl.
*H01R 11/09* (2006.01)

(52) U.S. Cl. ..... 439/723

(58) Field of Classification Search ..... 439/607.27, 439/607.26, 723, 724

See application file for complete search history.

(56) References Cited

U.S. PATENT DOCUMENTS

| | | | | |
|---|---|---|---|---|
| 4,794,269 | A | 12/1988 | Kawata et al. | 307/10 R |
| 5,605,465 | A * | 2/1997 | Kobayashi et al. | 439/76.2 |
| 5,643,693 | A | 7/1997 | Hill | |
| 5,676,558 | A | 10/1997 | Mayer | |
| 6,759,938 | B2 * | 7/2004 | Matsumura et al. | 337/161 |
| 2002/0132515 | A1 | 9/2002 | Hong | |

FOREIGN PATENT DOCUMENTS

| | | |
|---|---|---|
| DE | 36 09 704 A1 | 9/1987 |
| DE | 199 06 000 A1 | 8/2000 |
| DE | 100 17 484 A1 | 10/2001 |
| EP | 0417480 | 3/1991 |
| EP | 0 722 200 B1 | 7/1996 |

OTHER PUBLICATIONS

European Patent Office, Netherlands, Office Action dated Mar. 1, 2011, Application No. 07711718.2-1232, 6 pages.

*International Preliminary Report on Patentability*, International Application No. PCT/EP2007/001741; Date of Mailing Apr. 14, 2008 (German).

(Continued)

*Primary Examiner* — Phuong Dinh

(74) *Attorney, Agent, or Firm* — Sunstein Kann Murphy & Timbers LLP

(57) ABSTRACT

The invention relates to a potential distribution system for motor vehicles, which makes provision for a reserve on contact bars of an excess number of connection possibilities for further outlets. The connection possibilities which are not required can be closed off with a blanking plug and the connection possibilities which are required are brought in contact by means of an intermediate element, wherein the intermediate element can be designed as a fuse box or as an intermediate plug with integrated fuses.

6 Claims, 5 Drawing Sheets

OTHER PUBLICATIONS

Figure 1:
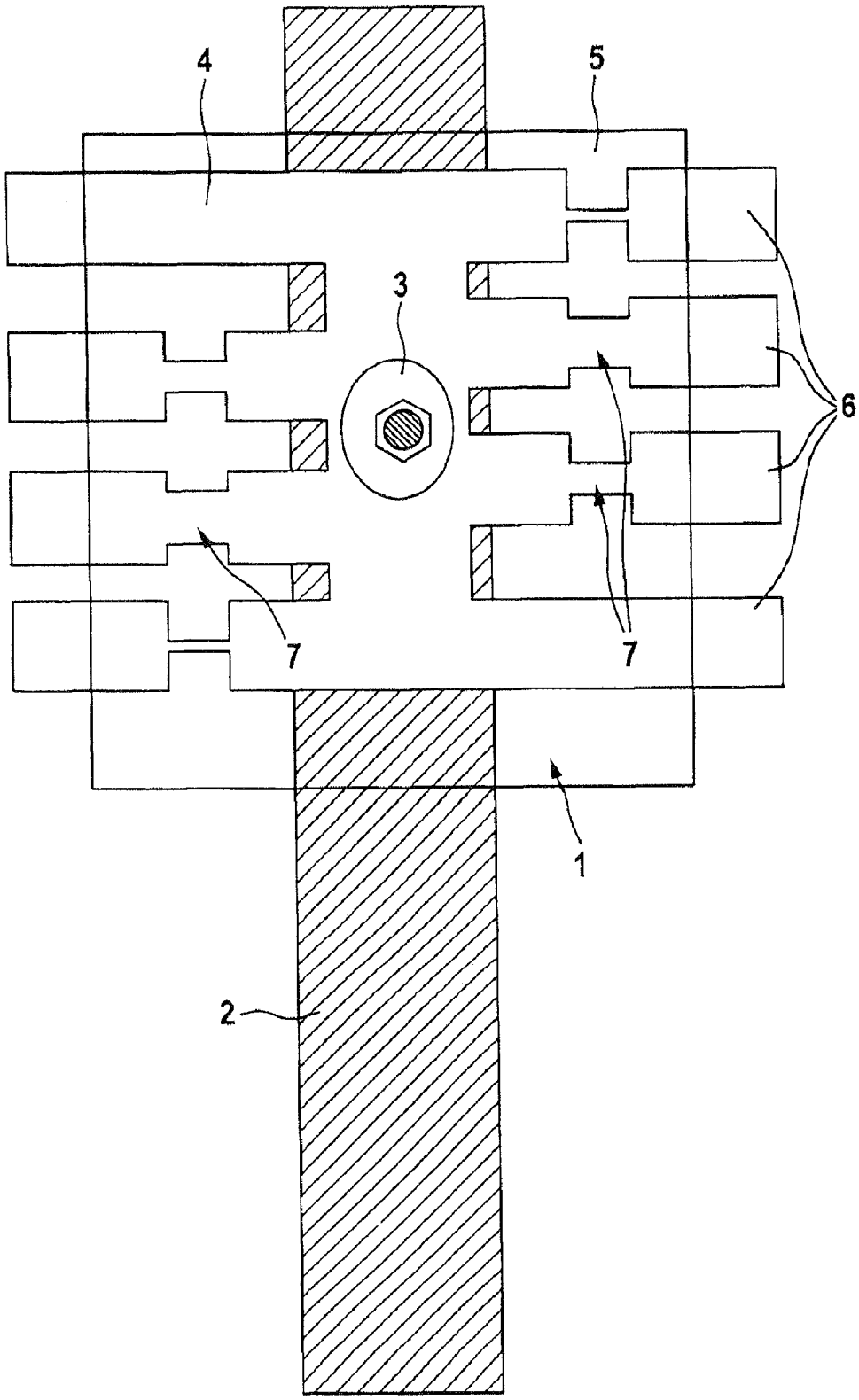

*International Search Report*, International Application No. PCT/EP2007/001741; Date of Mailing Jun. 21, 2007 (English).
Abstract (English) of foreign patent document DE 36 09 704 A1. Abstract provided by esp@cenet database—Worldwide.
Abstract (English) of foreign patent document DE 100 17 484 A1. Abstract provided by esp@cenet database—Worldwide.
Abstract (English) of foreign patent document DE 199 06 000 A1. Abstract provided by esp@cenet database—Worldwide.

* cited by examiner

ARRANGEMENT FOR CURRENT DISTRIBUTION AND CONTACT ARRANGEMENT AND FUSE PROTECTION THEREOF OF THE OUTGOING CABLES

The invention relates to a potential distribution system for motor vehicles, with which existing cable harnesses can be made slimmer.

High-current distribution in motor vehicles is effected as a rule by means of flexible or highly flexible circular cables or leads which are grouped together in bundles. These types of cable harnesses are flexibly slack and therefore often require an additional cable duct of stable form. The contact arrangement for cable harnesses can only be put into effect at fixed predetermined outlets from the cable harness and from the cable duct if present. As a rule, interim access is not possible, or only with very high effort and expenditure, since it is not provided in terms of design and is not desired.

In individual cases, pre-shaped rigid elements are used for bracing the cable harness. One example of this is known from the Siemens Patent Specification DE 3609704 C2. The bracing is achieved in this case by additional shaped elements made of plastic, onto which the cable harness is bound. The contact arrangements of the individual cables of the cable harness are provided at specially designed outlets or at plug connections provided in the design layout.

Likewise, with halogen lights for the lighting of rooms in buildings, potential distribution systems for 12 V DC are known. In order to meet the requirements for the very widely differing spatial distribution arrangements in buildings, in this case flexible distribution systems are proposed which have been made up beforehand. An example of such a potential distribution system is known from DE 10017484 C2. In this case, the potential distribution is put into effect with a bar plugging system. The circuit conductor structure in this case is located on a plastic carrier of the individual bar segments. The bar segments are connected among one another by connection elements to form the desired overall layout of the potential distribution system. Connection of the halogen lights is intended to be put into effect by means of plug connectors, which, in a comparable manner to the connection elements, are attached to the ends of the bar segments.

Also known is the use of connection boxes or distribution boxes for contact bars. In EP 0722200 B1, for example, it is proposed that plug connection possibilities be provided on a bar system for branching cable harnesses. The housing of the bar system and the plug connection possibilities are in this case manufactured from an artificial resin, such that the plug possibility can be cast together with the plastic housing of the bar system. Also previously known, according to EP 0722200 B1 are distribution boxes from a plastic housing, wherein the distribution box is simultaneously designed as a fuse box.

In on-board networks of motor vehicles, bar systems as a substitute for the cable harness have hitherto remained unknown. This may be attributable in particular to the higher costs of bar systems.

However, the known bar systems also offer too few advantages for use in motor vehicle on-board networks. The main disadvantage is the deficient flexibility, still perceived as inadequate, in respect of outlet possibilities. In particular, the fuse securing of the outgoing cables often does not allow for any flexibility with the known bar systems. It is precisely this, however, which is desirable for the on-board networks in these motor vehicles for retrofitting with additional consuming components or for handling the different equipment alternatives of such motor vehicles.

The object according to the invention is therefore to propose a bar system which is especially suitable for potential distribution in motor vehicles.

The solution is provided by a potential distribution system according to claim 1. Further embodiments are disclosed in the sub-claims and in the following description.

The solution is provided mainly by a bar system which makes provision for a reserve on the contact bars of an excess number of connection possibilities for further outlets. The connection possibilities which are not required can be closed off with a blanking plug and the connection possibilities which are required are brought in contact by means of an intermediate element, wherein the intermediate element can be designed as a fuse box or as an intermediate plug with integrated fuses.

The bar system can also be designed as a double bar system. One bar can then be used as an earth return. The bar system is then especially well-suited for the utility vehicle sector, in which on-board networks with earth returns are used.

Embodiments are explained in greater detail hereinafter on the basis of figures.

Figure 2:
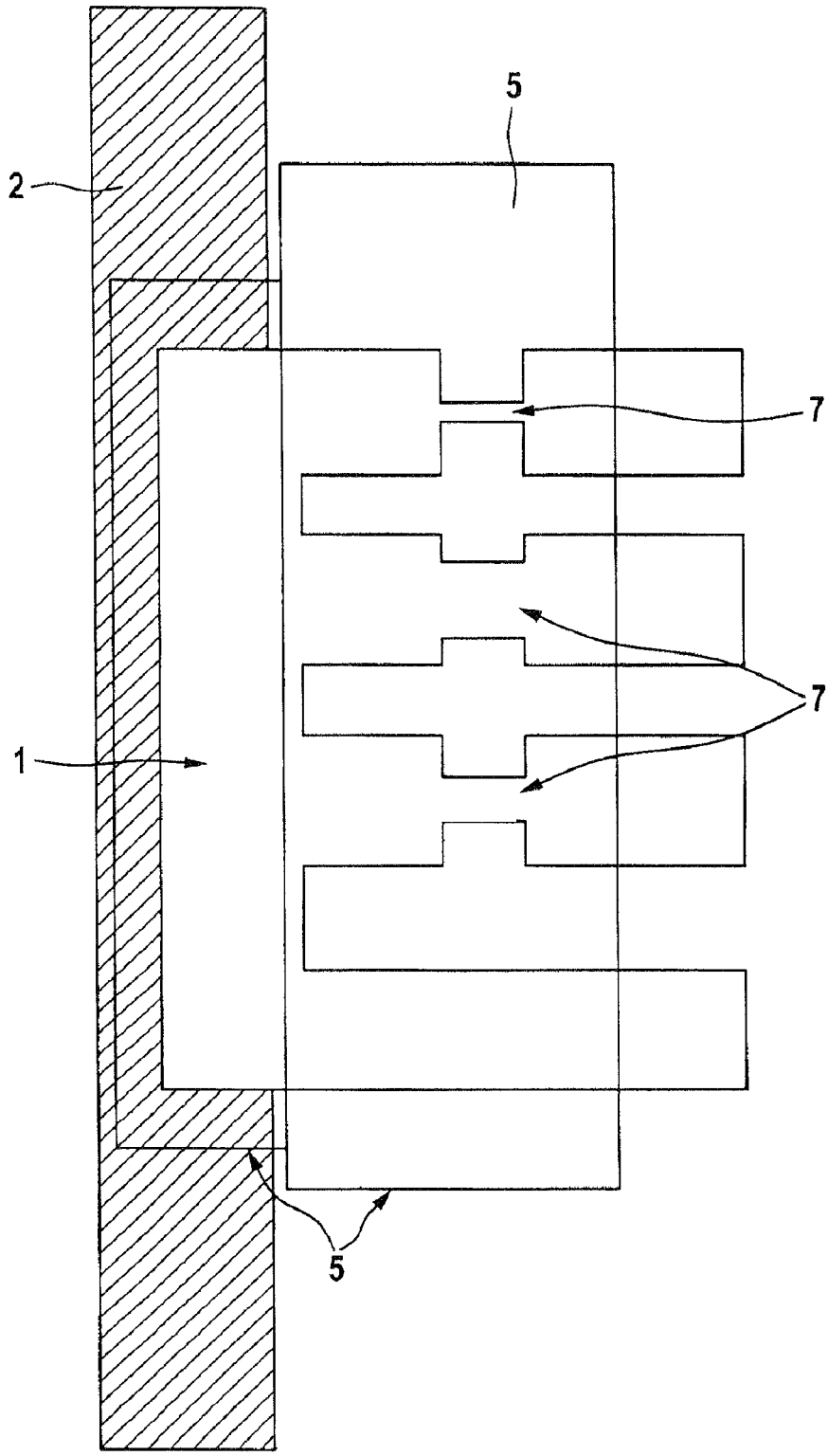
Figure 3:
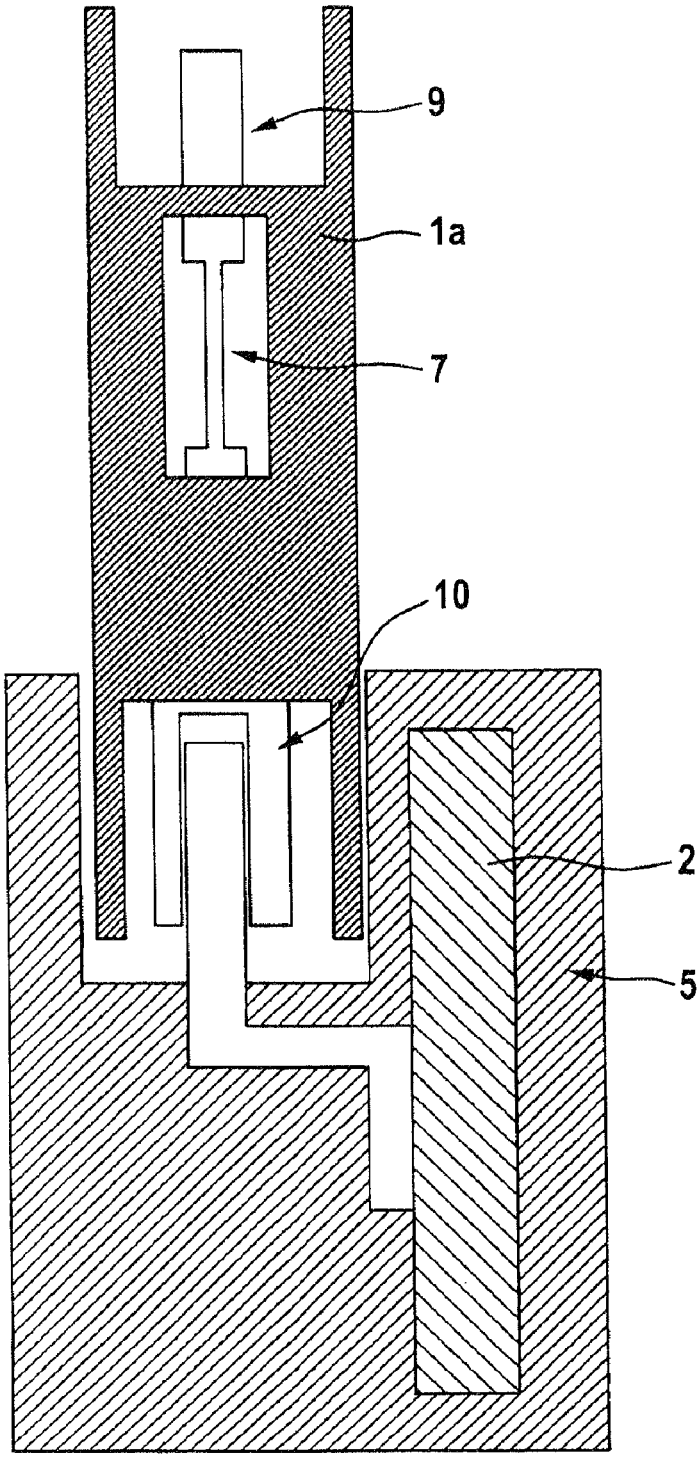
Figure 4:
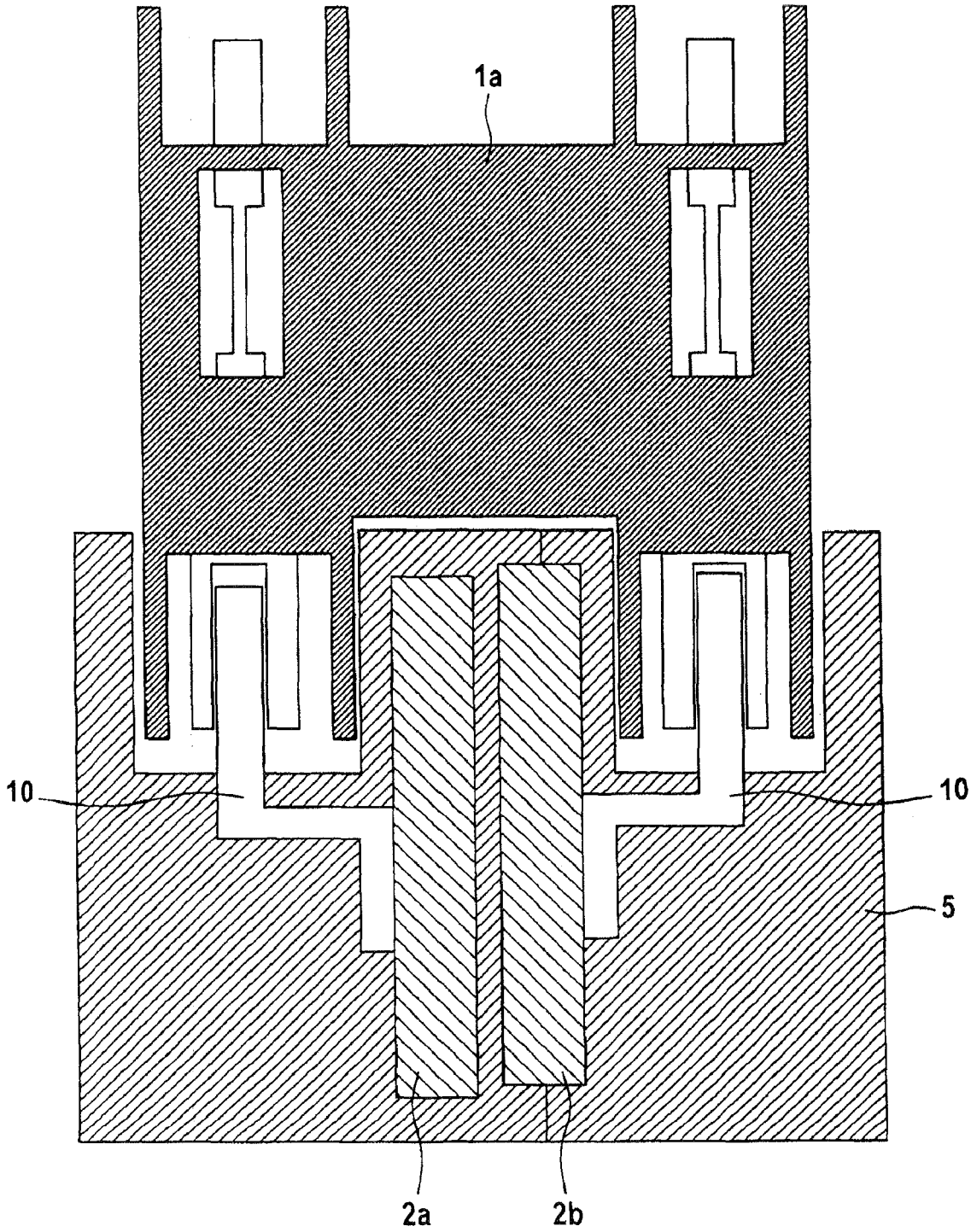
Figure 5:
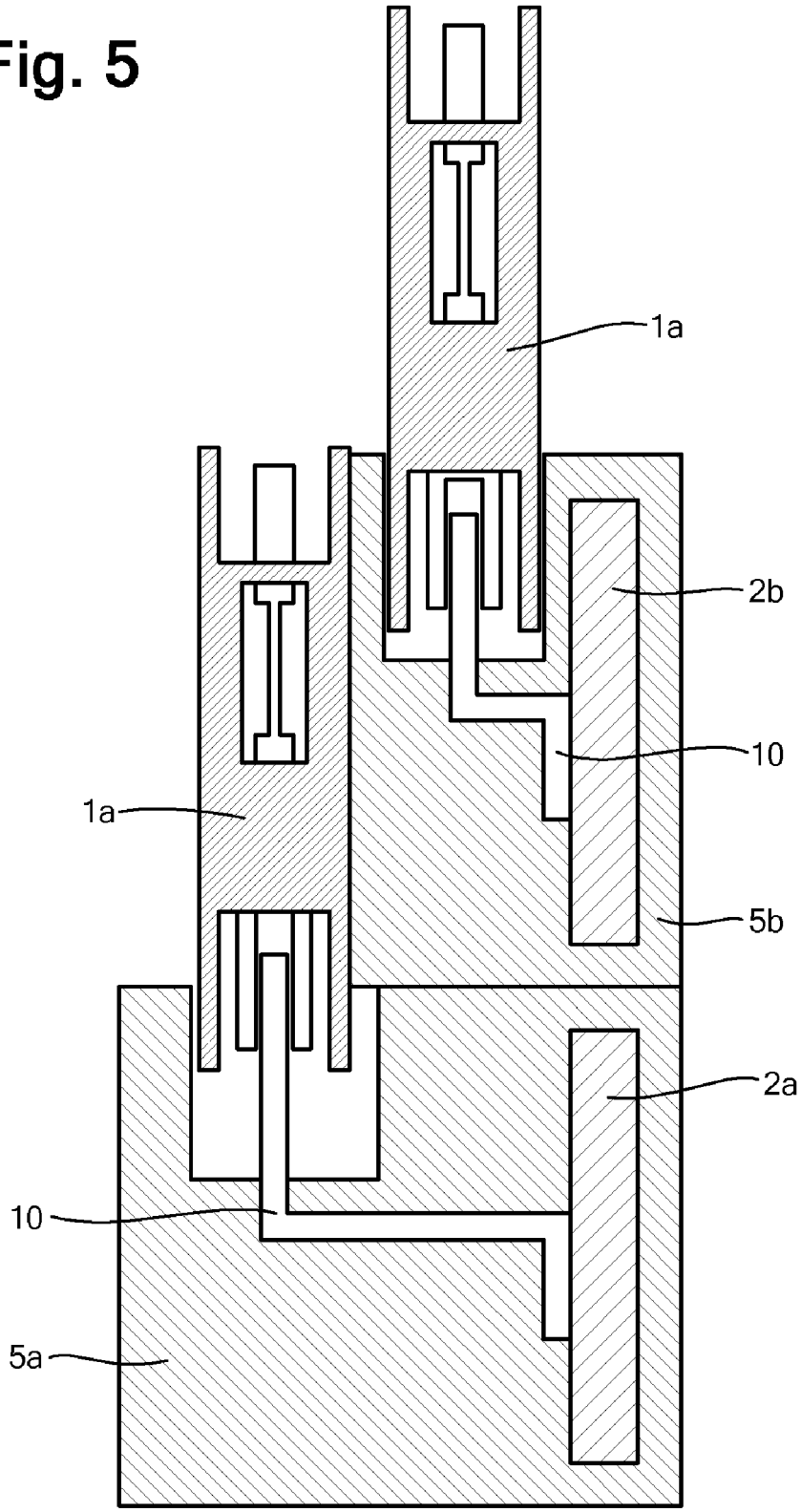

The Figures show:

FIG. 1 A first embodiment with a screw-connectable intermediate element,

FIG. 2 A further embodiment with a pluggable intermediate element,

FIG. 3 A further embodiment with an intermediate plug,

FIG. 4 An embodiment for a double bar system,

FIG. 5 A further embodiment for a double bar system.

FIG. 1 shows a first embodiment of the potential distribution system, in which an intermediate element 1 is formed as a fuse box, and wherein the intermediate element is contacted via a screw connection 3 to the contact bar 2. The screw connection is preferably used when the contact bar runs on the underfloor area of a motor vehicle and through-contacting takes place through the underfloor. This can be the case at the end of the bar but also along the course of the run. The screw connection is connected to the bar in material-joining fashion, e.g. by welding a threaded bolt into the contact bar. The intermediate element contains a metallic stamped grid 4 which is integrated into a housing 5. The stamped grid is formed by a plurality of electrical current branches 6. If required, a fuse element 7 can at the same time also be contained in the individual current branches, preferably as a cross-section tapering element in the current outlet branch of the stamped grid.

FIG. 2 shows another embodiment, in which the contacting of the intermediate element 1 is effected by means of a plug connection to the contact bar 2. Depending on the anticipated current loading, one or more contact lugs are located on the bar in material-joining fashion, e.g. by welding, clinching, soldering, etc. The outgoing direction of these contacts is preferably rotated through 90° in relation to the direction of run of the bar. These contact lugs are preferably already surrounded by injection with a moulding compound of plastic following on from the manufacturing process of the potential distribution system. This serves on the one hand to provide insulation and to protect the contact lugs, while on the other the surround injection can also be used as a plug housing, which is of significance in connection with the subsequent embodiments. The contact lug can in this context be one-part or multi-part in the output section. With multi-part outputs, the protective housing 5 is advantageously divided up into a plurality of chambers. If, depending on the configuration variant, not all the contacts are used, the unused chambers or contacts can be closed off with a blanking plug.

Figure 3A:
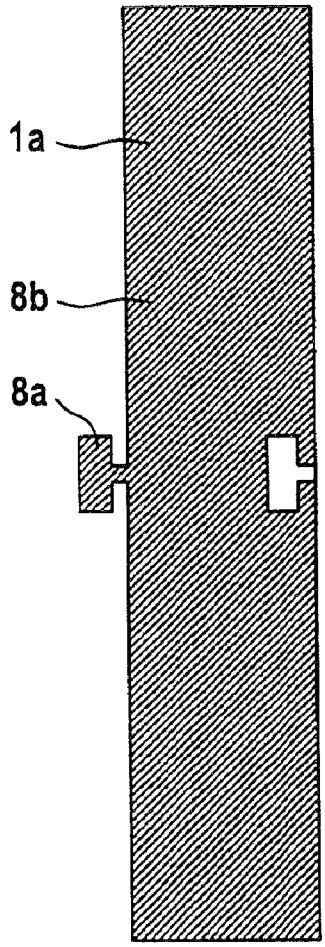

FIG. 3 shows an embodiment in which the intermediate element is designed as an intermediate plug 1*a*. The intermediate plug then also contains the fuse box In this situation the box can consist of individual fuse elements 7. It is also possible for a plurality of current branches to be integrated into the intermediate plug. It is also possible for a plurality of individual intermediate plugs to be connected to one another by way of their housings. These individual intermediate plugs la can then, as shown in the partial representation in FIG. 3*a*, be connected to one another by clips or a plug device which are introduced as matching plug elements 8*a* and cut-out apertures 8*b* onto or into the intermediate plug housing. In this way it is also possible for retro-fittings to be carried out by the removal of blanking plugs on the unused bar-side plug elements for the intermediate plugs and the use of additional intermediate plugs, or for variants to be covered.

The cable set for the consuming components to be connected is then simply fitted on the output side to a contact lug 9 of the intermediate plug. The contact arrangement of the intermediate plug with the contact bar likewise takes place by means of a plug-in contact lug 10. The housing of the bar-side contact lug 10 and the housing la of the intermediate plug engage in one another in a precise fit, and can additionally be formed with an engagement function, which supports the reliable mechanical retention of the plug connection.

The intermediate plug with the integrated fuses can naturally also be designed as one-piece with a plurality of parallel current branches, e.g. as a stamped grid solution.

A further embodiment of the potential distribution system is represented in FIG. 4. In this case, the potential distribution system is designed as a double bar system. In this case, two bars 2*a*, 2*b* are contacted simultaneously by an intermediate element, which in FIG. 4 is designed as an intermediate plug 1*a*. The two contact bars 2*a*, 2*b* to be contacted can in this situation preferably be integrated into a housing 5. To do this, the contact lugs 10 going out from the contact bars are located on different sides of the bars, one on the top of the bar 2*a* and one below on the other bar 2*b*. The potentials of these bars can be connected, for example with the standardised terminal 30, i.e. the input from the positive pole of the battery, and the potential from the terminal 15, i.e. the output to the ignition or driving switch, or the in-circuit terminal 30. In this case, fuses are located on the top side or the bottom side.

As an alternative, the potential distribution can be selected on both the contact bars in such a way that one contact bar lies on the potential from the terminal 30, while the other contact bar lies on the potential from the terminal 31, i.e. the return lead to the battery or negative pole or earth to the battery. Such an earth return is used, for example, in the on-board networks of utility vehicles. In this situation it would be sufficient if a fuse were to be integrated at the connection of the contact bar to the potential of the terminal 30 and a second fuse in the earth current path can be dispensed with.

If, with a multi-bar arrangement, it is not desirable for the contact bars to be grouped together as a double bar system, it is naturally also possible for two individual bars 2*a*, 2*b* to be laid next to one another with separated housings 5*a*, 5*b* in each case. This situation is represented in FIG. 5. Preferably, the two contact bar housings 5*a*, 5*b* to be laid next to one another are matched to one another in such a way that, for example, the housing of the one contact bar projects in height over the housing of the other bar, in such a way as to establish contact between the contact bars and an intermediate plug in the area of the projecting height. This is the case in particular if this projecting height is greater than the height of the intermediate plug 1*a*.

Instead of intermediate elements or intermediate plugs, it is of course also possible for control devices to be connected directly to the bar system.

It is also possible for two or more bars to be inserted in one plane, as a result of which a plurality of potentials can then also be divided. In this situation, the connection lugs can be arranged either laterally offset or above one another.

The invention claimed is:

1. A motor vehicle potential distribution system comprising:

a potential conducting contact bar system with a contact bar and a plurality of plug connections for electrically connecting to the contact bar;

an intermediate element pluggable into one of the plug connections in the contact bar system, wherein the intermediate element is a metallic stamping grid with a plurality of parallel current branches and a plurality of integrated fuses, at least one of the current branches comprising one of the integrated fuses; and an output side connection, on at least one of the current branches, onto which a consuming component can be fit.

2. Potential distribution system of claim 1, wherein the bar system is designed as a double bar system.

3. Potential distribution system of claim 1, wherein the output side connection comprises a contact lug.

4. Potential distribution system of claim 3, wherein the contact lug and the connection of the contact lug to the contact bar are cast in a common housing.

5. Potential distribution system of claim 1, further comprising a multi-bar system, wherein contact bar housings are matched to one another.

6. Potential distribution system of claim 5, wherein one contact bar housing projects over the other contact bar housing by at least the height of an intermediate plug.

* * * * *